United States Patent [19]

Hanson et al.

[11] Patent Number: 4,845,910

[45] Date of Patent: Jul. 11, 1989

[54] BASEBOARD MOLDING STRIP AND METHOD OF INSTALLING SAME

[76] Inventors: Dennis B. Hanson, 4762 Devon Way; Wendell T. DeLoach, 4770 Devon Way, both of Stone Mountain, Ga. 30088

[21] Appl. No.: 869,731

[22] Filed: Jun. 2, 1986

[51] Int. Cl.[4] ..... E04F 19/04

[52] U.S. Cl. ..... 52/288; 52/717.1; 52/746; 52/DIG. 13

[58] Field of Search ..... 52/717, 746, DIG. 13, 52/287, 288

[56] References Cited

U.S. PATENT DOCUMENTS

| | | | |
|---|---|---|---|
| 3,216,164 | 11/1965 | Stillman | 52/717.1 |
| 3,228,160 | 1/1966 | O'Brien | 52/242 |
| 3,391,434 | 7/1968 | Girard | 52/DIG. 13 |
| 3,408,250 | 10/1968 | Finefrock | 52/716 |
| 3,439,950 | 4/1969 | Kunevicius | 52/717.1 |
| 3,745,709 | 7/1973 | Perina | 52/DIG. 13 |
| 3,863,412 | 2/1975 | Bodycomb et al. | 52/DIG. 13 |
| 4,271,566 | 6/1981 | Perina | 52/DIG. 13 |
| 4,601,137 | 7/1986 | Bates | 52/242 |

FOREIGN PATENT DOCUMENTS

| | | | |
|---|---|---|---|
| 1227631 | 10/1966 | Fed. Rep. of Germany | 52/717 |

*Primary Examiner*—David A. Scherbel
*Assistant Examiner*—Caroline D. Dennison
*Attorney, Agent, or Firm*—James A. Hinkle

[57] ABSTRACT

An elastomeric baseboard molding and method of installing same that is removably attached to a wall by means of a hook and loop fastener system. The molding is manufactured with the hook and loop fastner pre-applied to the molding, and then, at the job site, a peel-off release strip exposes an adhesive coating that allows the molding with the fastener system to be applied to the wall. The hook and loop fastener system allows the molding to be removed whenever maintenance is needed upon the wall or floor located adjacent to the molding. The molding can be removed multiple times without losing its wall adhering qualities.

7 Claims, 1 Drawing Sheet

BASEBOARD MOLDING STRIP AND METHOD OF INSTALLING SAME

BACKGROUND OF THE INVENTION

I. Field of the Invention

The present invention relates generally to the construction industry and more particularly to the provision of a baseboard molding, more commonly called a cove base molding, which is capable of being applied to the base of a wall in conjunction with flooring material to provide a baseboard effect. More particularly, the invention pertains to a baseboard molding which is capable of being removed once it has been applied so that at desired times the baseboard molding may be removed for maintenance, painting or like activities and then replaced in its original position without having to destroy the molding and/or wall surface, and without having to replace the molding or any particular backing attachment material.

II. Description of Prior Art

The elastomeric baseboard molding is well known in the construction industry and has in the past been conventionally applied to a wall and its intersection with a floor by utilizing a suitable adhesive on the back of the molding, and then placing the molding against the wall so that the adhesive will set firmly and hold the baseboard molding to the wall.

In the prior art, the conventional method for applying such baseboard molding strips includes the steps of cutting a proper length of the molding and then applying suitable adhesive to either the back of the molding or to the wall to which the molding will be attached. Frequently when the installer applies the molding to the wall excess paste is pressed out of the junction point and is normally smeared on the wall, especially if the molding is misaligned when being installed and the installer corrects the misalignment by repositioning the molding. In the past it has also been found that it is difficult to secure a tight fit of the molding against the wall at the top of the molding and against the floor at the bottom of the molding if there are any irregularities in the floor. With such irregularities, the installer usually is forced to bend the molding as much as possible to effect a fit, but then this means that the freshly applied paste is squeezed out of the molding and onto the wall surface which will make a smeared finished product. Not only that, but the paste has very little shear strength and the molding will not stay flexed to matingly engage with the irregular floor surface to obtain a tight seal with the floor.

In order to prevent the problems of the conventional baseboard cove molding strip application process, a pressure sensitive adhesive has been proposed to cover the backside of the cove molding so that the molding may be then more easily affixed to the wall surface. Such a system is shown in U.S. Pat. No. 3,408,250. However, with such a system certain problems still exist in that the adhesive so utilized still does not have sufficient shear strength to maintain the molding in the proper position against the wall.

In addition to the problem noted in the above system of the referenced patent, it is obvious that if the molding needs to be removed for adequate cleaning and sterile environments, or if it is desired to repaint the wall and avoid splattering paint on the molding as is now quite common, there is no way to remove the molding, paint the wall, and then replace the molding with the prior adhesive, since it is well known that once the original adhesive seal is broken the adhesion quality is significantly reduced.

SUMMARY OF THE INVENTION

It is therefore an object of the present invention to provide an elastomeric baseboard molding system wherein the molding may be set in place against a wall and tightly engaged with a floor to remain in that particular condition until removed.

It is another object of this invention to provide a molding strip that may be installed easily without applying a paste or glue, or other adhesive to the wall or to the molding strip to effect permanent placement of the strip.

Another object of the invention is the provision of elastomeric baseboard strip that may be applied to align with irregularities in the wall and floor, and which will maintain such alignment.

It is yet another object of the invention to provide an elastomeric baseboard molding strip that once it is applied to a wall surface it may be removed repeatedly without destroying any of its adhesion characteristics, and may be repeatedly replaced in the same location.

It is still another object of this invention to provide a method of installing a baseboard molding strip having a wall contacting surface which has a self gripping fastener comprising of two parts, one of which adheres to the wall and one which adheres to the baseboard strip, and which are releasably engaged with one another.

Other objects, advantages and capabilities of the invention will become apparent from the following description, taken in conjunction with the accompanying drawings, showing only a preferred embodiment of the invention.

DESCRIPTION OF THE PREFERRED EMBODIMENT

Figure 1:
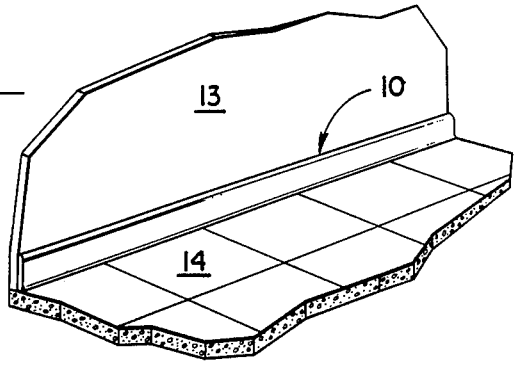
FIG. 1 is a perspective view of a wall and floor section showing the baseboard molding strip of the present invention installed at the junction of the floor and wall.
Figure 2:
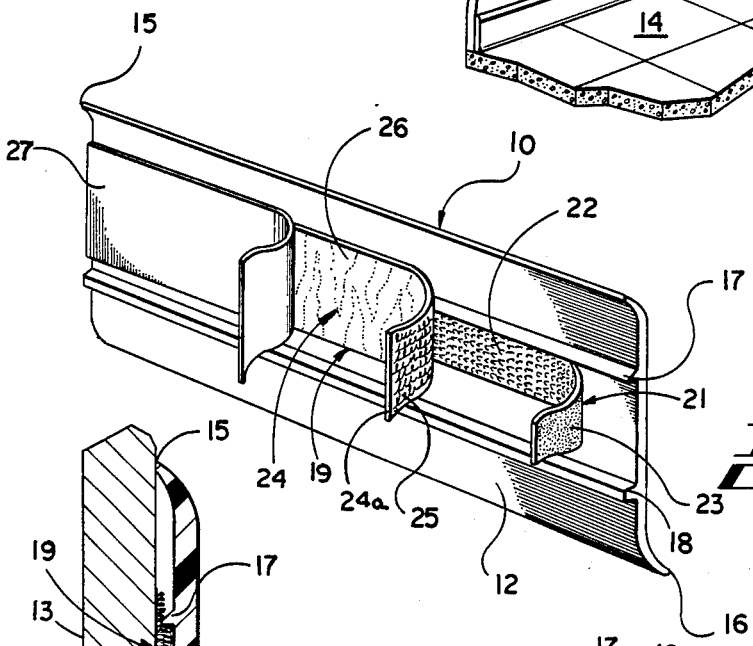
FIG. 2 is a perspective view showing the rear portion of the baseboard molding strip, and particularly showing the details of the self gripping fastener.

Referring to the drawings, wherein like numerals designate corresponding parts throughout the several figures, the baseboard molding strip of the present invention is indicated by numeral 10. The strip 10 may comprise an extruded length of elastomeric material and includes a front face portion 11 and a rear face portion 12 which define the shape of the base. As is commonly observed in construction practice, the baseboard molding strip 10 is suitably placed at the juncture of a wall section 13 and a floor section 14. As can be readily seen from FIGS. 1 and 3, the strip 10 is placed against the wall section so that the tip 15 of the molding is in contact with the wall section, and the toe 16 is in operative contact with the floor section.

Figure 3:
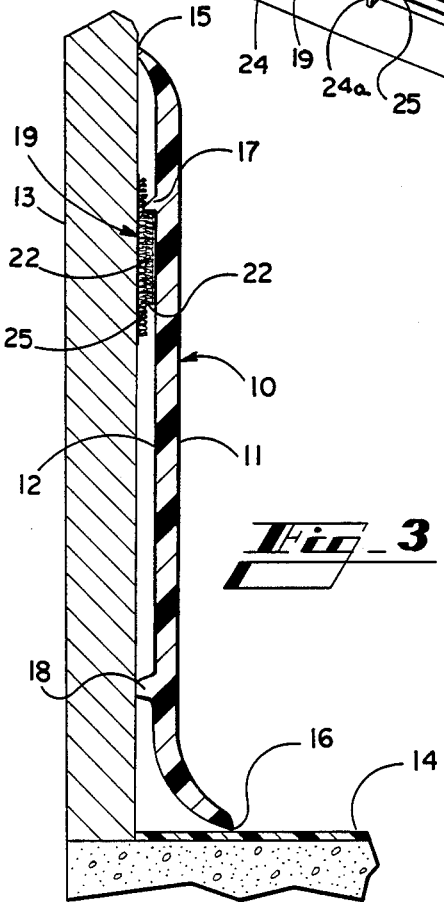
FIG. 3 is a vertical section view taken through a representative sample of the baseboard molding strip showing it in place against a typical wall and floor system.
Figure 4:
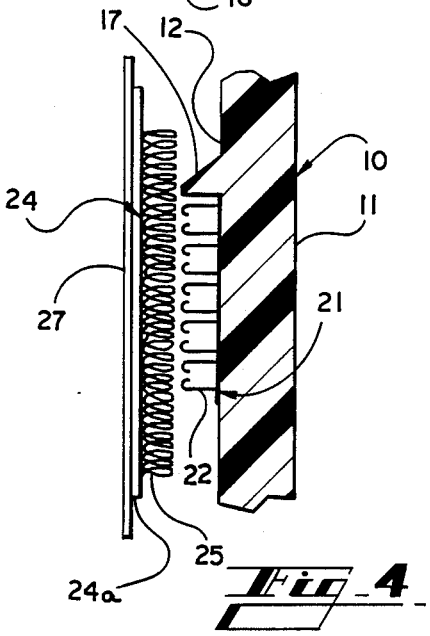
FIG. 4 is an exploded view of a portion of the vertical section of FIG. 3, showing details of the hook and loop fastening system utilized to hold the molding strip in place.

On the rear face 12 of the molding strip there is provided two rib members. While in the preferred embodiments two rib members are shown, it, of course, is evident that more or less rib members may be utilized depending on the installation and depending upon the configuration of the particular molding strip. In the preferred embodiment, however, an upper rib guide member 17 is provided and as can be seen in FIGS. 3 and 4, this rib has a predetermined depth so that it does not necessarily contact the wall surface. Closer to the bottom of the molding strip, there is provided a second stabilizer rib 18 which is designed to have the same projection towards the wall surface as does the tip 15. Therefore, when the molding strip is in proper position, the stabilizer rib 18 contacts the wall surface to give to the molding strip a stabilizing effect and to maintain the proper standoff distance of the molding strip from the wall surface. Likewise, when in operative position the rib guide 17 does not touch the wall surface and its function generally is to provide a guide means so as to provide a guide for the attachment to the molding strip of the self gripping hook and loop fastener 19.

The self gripping hook and loop fastener 19 may be any of the commercially manufactured fasteners such as is shown herein. After considerable testing, it has been found that this particular type of fastener will operate quite well in the environment in which the invention is intended. The fastener 19 comprises a strip of hook tape 21 having affixed to it a special texturized yarn providing many hook filaments securaly imbedded within the hook tape 22. On the side of the hook tape 21 opposite from the hooks 22, there is provided an adhesive backing material 23 which affixes the hook tape 21 to the rear face 12 of the molded strip 10. Any commonly used adhesive backing material may be utilized, the only requirement being that it will withstand chemicals and other cleaning solvents utilized in the cleaning and care of floors. It is within the preview of this invention that the adhesive 23 may be a pressure sensitive type, or may be one of the common chemically activated adhesives.

The second portion of the fastener 19 comprises a strip of loop tape 24 which has embedded therein on one side thereof in the carrier strip 24*a*, multiple monofilament loops 25 which are designed to interract with hooks 22, thereby effecting a fastening process as is well known. On the side of the loop tape 24, which side is the backing side of the loops 25, is an adhesive backing material which like the backing material 26 on the hook tape, is a pressure sensitive coating. Protecting the pressure sensitive coating 26 during shipment and handling, there is a conventional peel-off release strip 27 that is releasably secured to the adhesive backing material 26 of the loop tape 24. The peel-off strip 27 may be peeled from the rear of the loop tape 24 during installation in a manner which will now be explained. Of course, conventional pressure sensitive adhesive is available on the market at the present time which has a sufficient shear strength and adhesive strength to overcome any tendency of the molding strip 10 to slide vertically along the wall 13. As is well known, one of the values of this type of baseboard is that it will conform to irregularities in a floor system and maintain itself tightly thereto.

It is anticipated that after the baseboard molding strip 10 has been extruded during manufacturing, the self gripping hook and loop fastener 19 would be applied to the rear face 12 of the base. At that point the entire unit would be shipped in strips as is currently done, and installed at the job site. However, it may well be that it will prove practical to ship the molding strips 10 and the fastener system 19 separately and then install the fastener on the job site. However, in any event, the fastener 19 would be affixed to the rear face 12 of the molding strip by placing the adhesive backing material 23 of the hook tape21 to the rear face 12 of the base and positioning that hook tape immediately adjacent to the rib guide 17. This will give an even appearance and will assist in securing the hook tape 21 to the molding strip, and to prevent it from slipping in a vertical manner. Of course, at the time the hook tape is placed in its proper position, it may well be that the loop tape is already in position interfacing with the hook tape, and nothing else needs to be done except to package and ship the molding strip 10. Of course, it may be that the loop tape may be separated and then applied at a later time.

At this time it is believed that the loop tape and hook tape, along with the release strip covering the adhesive portion of the loop tape would be installed all at the same time and the entire system would then be shipped as a unitary unit.

To install the molding strip of the present invention, the user would peel off the release strip 27, thereby exposing the adhesive 26 of the loop tape. The molding strip 10 would then be placed in the desired position with the tip 15 firmly against the wall surface, and the toe 16 firmly against the floor surface along its entire length. The user would then press the baseboard molding strip 10 against the wall surface so that the stabilizer rib 18 would be in contact with the wall, and to affix the pressure sensitive adhesive material 26 of the loop tape to the wall. This action would then complete the mounting of the baseboard and additional strips could be mounted in the same manner along the wall floor junction as is needed.

The present invention has shown where a cove type baseboard molding strip can be affixed to the wall and floor unit merely by removing a peel off release strip from a pressure sensitive adhesive or a chemically activated backing material. The strip can then be easily placed against the wall and in contact with the floor, without the application of messy and time consuming glues. Equally important is the fact that if it is desired to clean the wall floor junction, or to paint the wall without dripping paint onto the cove base, it is a simple matter to remove the cove base with normal finger pressure, thereby releasing the hook and loop fastening system in its normal and conventional manner. Once the cleaning and/or painting has been completed the user then merely replaces the strip 10 in its previous location by placing it against the wall and floor and applying pressure at the junction point of the hook and loop fastener 19. Such a procedure can be done indefinitely without destroying the fastening system 19. Another benefit of the present invention is that the more pressure placed to the fastening system 19, the greater the gripping pressure that is effected, and it has been found that after repeated bumps against the strip 10 of the present invention that there is virtually no movement to the strip, and it stays in its intended position resisting any tendency to slide with respect to the wall 13.

Various modifications may be made of the invention without departing from the scope thereof, and it is desired, therefore, that only such limitations shall be placed thereon as are imposed by the prior art and which are set forth in the appended claims.

What is claimed is:

1. A baseboard molding removably affixed at the juncture of a wall assembly and a floor assembly comprising, a formed elastomeric baseboard member, the baseboard member having an upper wall engaging tip portion and a lower floor engaging toe portion, a panel portion interconnecting the tip portion and the toe portion, the panel portion having a front side and a rear side, the rear side being adapted to be mounted adjacent to the wall assembly, the tip portion having a re-entrant projection to provide a predetermined standoff distance for the rear side from the wall assembly, the rear side having an integral upper rib guide projecting from the rear side, wherein the upper rib guide projects to a predetermined distance from the rear side of the panel portion, an integral lower rib stabilizer projecting from the rear side, the lower rib stabilizer having a projecting length which is of sufficient length to match the standoff distance defined by the re-entrant projection of the tip portion, wherein when the baseboard member is in operative position, the lower rib stabilizer contacts the wall assembly, fastening means secured to the baseboard member, the fastening means comprising a two-piece hook and loop fastener, wherein the two piece hook and loop fastener is affixed adjacent to and in juxtaposition with the upper rib guide the first piece of the fastener being affixed to the baseboard member, the second piece of the hook and loop fastener being releasably engaged with the first piece and having adhesive means integral therewith, whereby when the baseboard member is placed in position at the juncture of the wall assembly and the floor assembly, the adhesive of the second piece of the fastener member contacts the wall assembly and releasably secures the baseboard member thereto.

2. A baseboard molding as claimed in claim 1, wherein the predetermined projecting distance of the upper rib guide is less than the length of the lower rib stabilizer.

3. A baseboard molding as claimed in claim 1, wherein means are provided to overlay the adhesive of the second piece of the fastener member to prevent adhesion until the time for intended usage of the baseboard molding.

4. A baseboard molding as claimed in claim 3, wherein said overlay means is releasably secured to the adhesive of the second piece of the fastener member.

5. A baseboard molding as claimed in claim 4, wherein the piece of hook fastener comprises multiple hook members imbedded in a hook carrier strip of material having adhesive backing on said carrier strip, the piece of loop fastener comprising multiple randomly disposed loop members imbedded in a loop carrier strip of material having adhesive backing on said carrier strip.

6. A method of installing a baseboard molding at the junction of a wall assembly and a floor assembly, comprising the steps of providing a formed elastomeric baseboard molding having tip and toe portions and further having a front side and a rear side and an upper projecting rib and a lower projecting rib stabilizer, affixing to the rear side a two piece hook and loop fastener, providing the hook piece of fastener with multiple hook members imbedded in a hook carrier strip of material, providing the loop piece of fastener with multiple randomly disposed loop members imbedded in a loop carrier strip, placing the hook piece of the fastener adjacent to the rear side of the molding in juxtaposition with the upper projecting rib, overlaying the loop portion of the fastener with the hook portion of the fastener, providing adhesive to the side of the loop carrier strip opposite the loop attachment side, providing a removable peel-off strip overlaying the adhesive of the loop carrier strip for use during shipment, removing the carrier strip at the job site of intended usage of the baseboard molding, placing the tip portion of the baseboard molding in operative position touching the wall assembly, placing the toe portion of the baseboard molding in operative position touching the floor assembly, exerting pressure along the area of the fastener means to effect adhesion of the fastener means to the wall assembly.

7. A method of installing a baseboard molding at the junction of a wall assembly and a floor assembly, comprising the steps of providing a formed elastomeric baseboard molding having tip and toe portions and further having a front side and a rear side and an upper projecting rib and a lower projecting rib stabilizer, affixing to the rear side a two piece hook and loop fastener, providing the hook piece of fastener with multiple hook members imbedded in a hook carrier strip of material, providing the loop piece of fastener with multiple randomly disposed loop members imbedded in a loop carrier strip, placing the hook piece of the fastener adjacent to the rear side of the molding in juxtaposition with the upper projecting rib, overlaying the loop portion of the fastener with the hook portion of the fastener, providing adhesive to the side of the loop carrier strip opposite the loop attachment side, providing adhesive means upon the loop carrier strip, placing the tip portion of the baseboard molding in operative position touching the wall assembly, placing the toe portion of the baseboard molding in operative position touching the floor assembly, positioning the adhesive means of the loop carrier strip adjacent the wall assembly, activating the adhesive means of the loop carrier strip to effect adhesion of the fastener means to the wall assembly.

* * * * *